United States Patent [19]

Cline

[11] 4,193,387

[45] Mar. 18, 1980

[54] HIGH EFFICIENCY HEAT RETURN FIREPLACE

[76] Inventor: Oren W. Cline, R.R. #3, Edwardsville, Ill. 62025

[21] Appl. No.: 820,304

[22] Filed: Jul. 29, 1977

[51] Int. Cl.[2] ..... F24B 7/00

[52] U.S. Cl. ..... 126/121

[58] Field of Search ..... 126/121, 122, 131; 237/51; 165/170, 171

[56] References Cited

U.S. PATENT DOCUMENTS

| | | | |
|---|---|---|---|
| 174,829 | 3/1876 | Lucas | 126/122 |
| 2,161,723 | 6/1939 | Rutland | 126/121 |
| 2,375,318 | 5/1945 | Mudgett | 126/121 |
| 2,743,720 | 5/1956 | Dollinger | 126/121 |
| 2,863,443 | 12/1958 | Hoffman | 126/121 |
| 3,538,719 | 11/1970 | Pradel | 165/170 X |
| 4,008,707 | 2/1977 | Bartlett | 126/131 |
| 4,026,263 | 5/1977 | Boyd | 126/121 |
| 4,059,090 | 11/1977 | Shaw | 126/121 |

FOREIGN PATENT DOCUMENTS

| | | | |
|---|---|---|---|
| 18353 | 11/1895 | United Kingdom | 126/121 |

*Primary Examiner*—Lloyd L. King
*Assistant Examiner*—Harold Joyce
*Attorney, Agent, or Firm*—Lionel L. Lucchesi

[57] ABSTRACT

A high efficiency heat return fireplace unit is provided which includes an enclosure having outer and inner housings. The inner housing defines a fire box which communicates with the atmosphere through a suitable flue-chimney structure. The inner housing is spaced from the outer housing so as to define a heat chamber about the fire box. At least the bottom wall of the inner housing has an undulating shape in cross section so that the bottom wall defines a series of heat pipes along the bottom of the fire box. The heat pipes communicate with the heat chamber. A plurality of hot air returns extend depthwise along the top of the fire box. The hot air returns also communicate with the heat chamber and return heated air to the room in which the fireplace is located. In the preferred embodiment, the side walls of the inner enclosure also have an undulating shape in cross section so that a large surface area is available for heat transfer between the fire box and the heat chamber, thereby greatly increasing the heat transfer efficiency of the fireplace.

4 Claims, 9 Drawing Figures

HIGH EFFICIENCY HEAT RETURN FIREPLACE

BACKGROUND OF THE INVENTION

This invention relates to fireplace construction, and in particular, to a high efficiency heat return fireplace capable of insertion in conventional fireplace openings.

A variety of heat return fireplaces and stoves are known in the art. While these devices work for their intended purposes, the invention disclosed hereinafter may be distinguished therefrom by certain novel features which provide improved heat transfer characteristics and simplified construction.

One of the objects of this invention is to provide a high efficiency heat return fireplace.

Another object of this invention is to provide a heat return fireplace having simplified construction.

Another object of this invention is to provide a fireplace having first and second housings, the bottom wall of the second housing defining a plurality of heat pipes on which the combustible material is consumed.

Another objective of this invention is to provide a heat return fireplace in which air may be heated from the fireplace on at least five sides of a fire box, the fire box generally being shaped as a parallelpiped.

Other objects of this invention will be apparent to those skilled in the art in light of the following description and accompanying drawings.

SUMMARY OF THE INVENTION

In accordance with this invention, generally stated, a high efficiency heat transfer fireplace is provided in which the walls of the fire box are constructed from a material having an undulating cross section. The fireplace includes an enclosure having first and second housings spaced from one another to define a heat chamber about the fire box. The bottom wall of a fire box is defined at least in part by a plurality of pipes communicating with the heat chamber. The heat chamber also is connected to a heated air outlet by a plurality of pipes which extend across the upper end of the fire box. In the preferred embodiment, the heat chamber surrounds the fire box on at least five sides thereof.

DESCRIPTION OF THE PREFERRED EMBODIMENT

Figure 1:
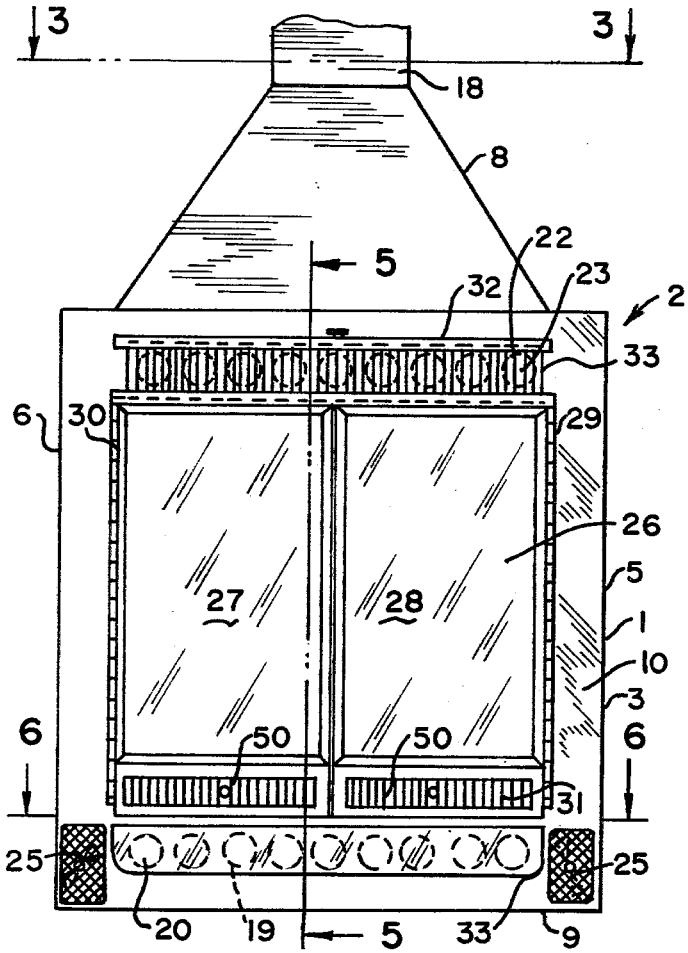
FIG. 1 is a front view of one illustrative embodiment of fireplace of this invention.
Figure 2:
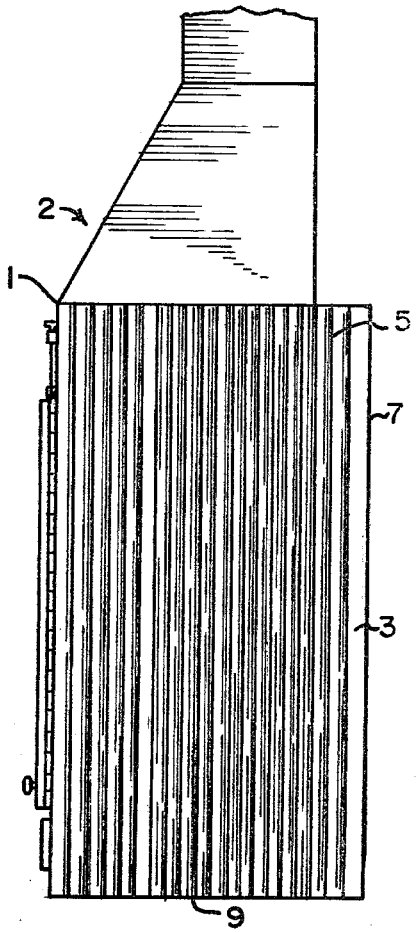
FIG. 2 is a side elevational view thereof.
Figure 3:
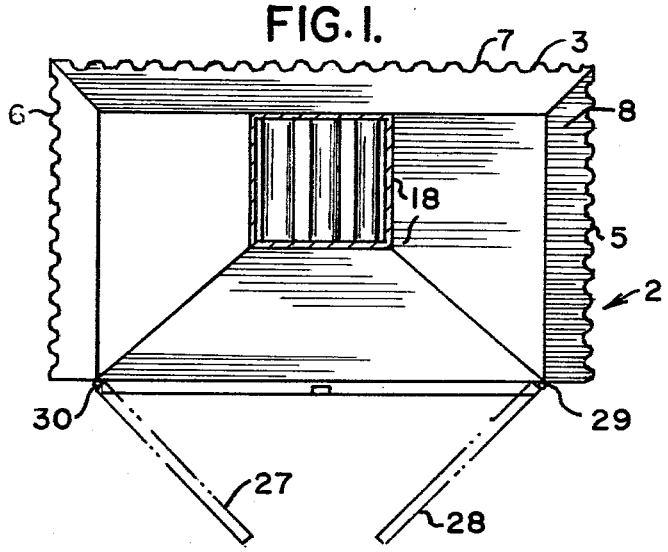
FIG. 3 is a top plan view taken along the line 3—3 of FIG. 1.
Figure 6:
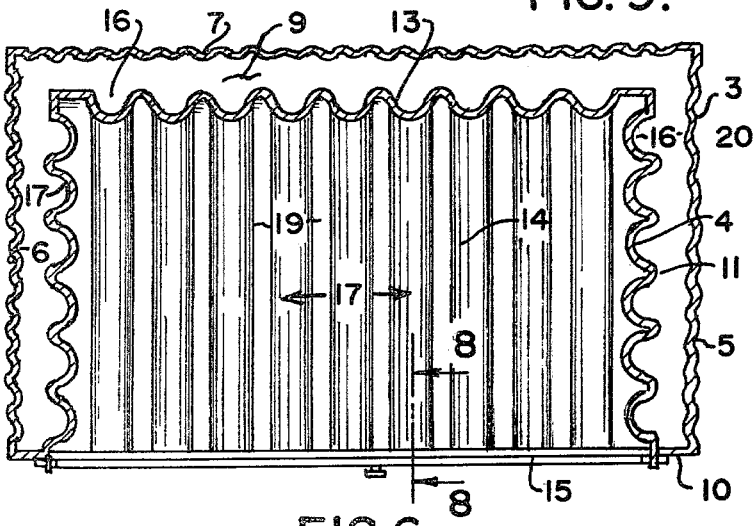
FIG. 6 is a sectional view, partly broken away, taken along the line 6—6 of FIG. 1.

Referring now to FIG. 1, reference numeral 1 indicates an enclosure for a fireplace 2. As is best seen in FIG. 6, the enclosure 1 includes an outer or first housing 3 and an inner or second housing 4.

The housing 3 generally is rectangular and includes a first pair of oppositely opposed side walls 5 and 6, a back 7, a top 8, a bottom 9 and a front 10.

The housing 4 is similar to the housing 3 and includes a pair of oppositely opposed side wall 11 and 12, respectively, a back 13, a bottom 14 and a generally open front 15. The top 8 and the front 10 of the outer housing 3 also serve to close the front and top of the housing 4.

The housings 3 and 4 where appropriate, are constructed from an undulating or corrugated material capable of rapid heat transfer. Conventional boiler plate steel, with the appropriate cross section, works well, for example. As is observable in FIG. 6, the embodiment illustrated has varying dimensions for the peaks and valleys of the undulations of the respective walls forming the housings 3 and 4. The dimension choice for the respective housings is a matter of design preference, and those dimensions may vary in other embodiments of this invention.

The housings 3 and 4, while generally coextensive with one another, are sized so that the housing 4 may be spaced from the housing 3 to define a heat chamber 16 in the volume between them. The heat chamber 16 substantially surrounds the housing 4 along the sides 11 and 12, the bottom 14, and the back 13.

The housing 4 defines a fire box 17 which is closed by the top wall 8 of the housing 3 and operatively connected to a flue or chimney 18 for venting the exhaust gases of combustion. The various side walls of the housings 3 and 4 may be interconnected by any convenient method. Welding works well, for example.

Figure 7:
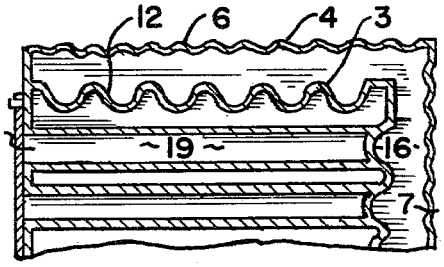
FIG. 7 is a sectional view, partly broken away, generally corresponding to FIG. 6 but illustrating a variation in design.

As indicated above, the walls of the housings 3 and 4 are constructed from an undulating or corrugated material which greatly increases the heat transfer area between the fire box 17 and the heat chamber 18. The fireplace 2 of this invention also is distinguishable from similar devices in the prior art because of its novel use of a plurality of heat pipes 19, best seen in FIG. 4, which extend the depth of the fore box 17. The heat pipes 19 are open to the room environment of the fireplace 2 along an end 20 of the pipes, and communicate with the heat chamber 16 along an end 21 of the pipes. The heat pipes 19 in part define the bottom 14 of the housing 4. In the embodiment illustrated in FIG. 6, the pipes 19 are shown as individually constructed tubular pipes. However, those skilled in the art will recognize that the undulations of a suitable plate defining the bottom 14, if properly constructed, may be used to delimit the pipes 19 so that individual pipes are not required in other embodiments of this invention. Such an illustrative variation is shown in FIG. 7. As indicated, the pipes 19 are placed so that they at least in part define the bottom wall 14 and the combustible material may be placed on or near the pipes 19 so that air passing through the pipes comes into intimate contact or pass closely along the heat source in the fire box 17.

Figure 4:
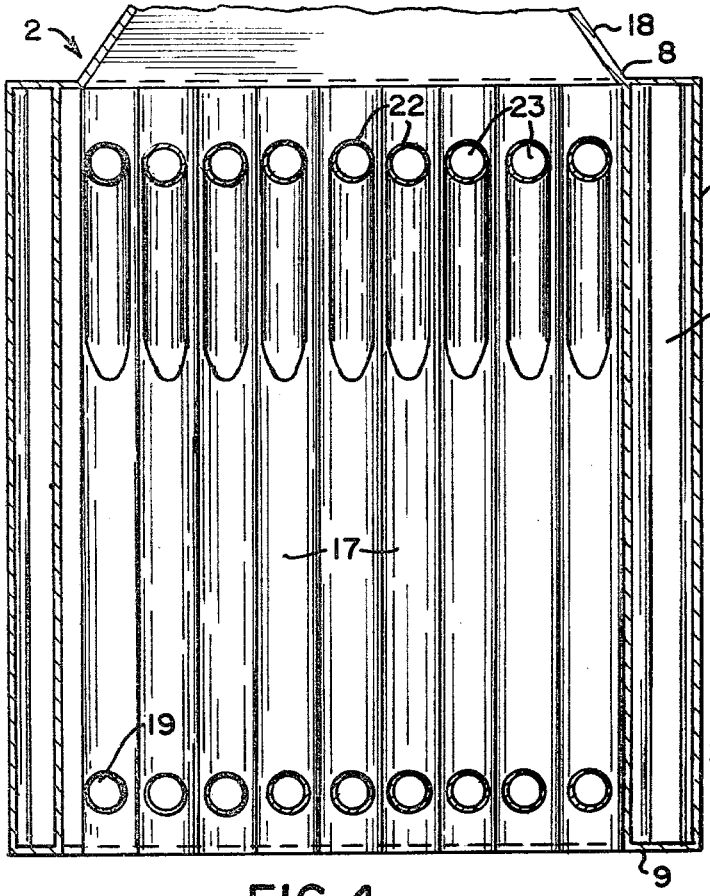
FIG. 4 is a front elevational view corresponding to the view of FIG. 1, the front facing of the fireplace being removed for illustrative purposes.

The fireplace 2 also has a plurality of vent pipes 22 having a first end 23 opening into the room environment of the fireplace 2, and an end 24 communicating with the heat chamber 16. It thus may be observed that the fireplace 2 is constructed so that an air flow pattern may be established about the fire box 17. That is to say, air enters the end 20 of the heat pipes 19, where it is heated as it passes along the bottom of the fire box 17. Natural convection will cause the heated air to rise in the heat chamber 16 and enter the end 24 of the pipes 22 and thence back into the room environment of the fireplace 2 through the end 23 of the pipes 22. Since the fire box 17 is surrounded by the heat chamber 16, the air is heated along its entire path of travel and the heat transfer efficiency of the fireplace 2 is considerably greater than that available with prior art designs. As shown in FIG. 4, the heat chamber 16 is closed along both the top 8 and bottom 9 of the fireplace 2. Consequently, all air input to the heat chamber 16 necessarily must exit through the pipes 22. The pipes 22 themselves, in passing through the fire box 17 permit the air to be heated as the pipes 22 are positioned to enable them to absorb heat from the hot gasses passing into the chimney 18. It thus may be observed that the fireplace makes maximum use of the heat output available from the fireplace 2 in a relatively simple and low cost construction.

A number of modifications may be made to the fireplace 2 in order to enhance its utilitarian functions. Thus, for example, power operated air movers in the way of fans 25, best observed in FIG. 1, may be provided to force additional air into the heat chamber 16. The fans 25 also provide a positive air flow movement through the heat chamber 16 and the heat pipes 22. The fans 25 themselves may be conventional. A number of electrically operated devices are commercially available which are suitable for use in the fireplace 2.

The front 15 of the fireplace 2, in the embodiment illustrated, is closed by a glass closure 26. The closure 26 is available commercially and includes a first door 27 and a second door 28 which are hingedly mounted to the fireplace 2 along an edge 29 and 30, respectively, in a conventional manner. A lower side 50 of the doors 27 and 28 is provided with adjustable louvers 31 to control air flow into the fire box 17, thereby regulating the amount of air available for the combustion in the fire box. In the alternative, the doors 27 and 28 may be constructed from metal so that they too become radiators of heat energy from the fire box 17. Aesthetically, use of the glass doors generally is more pleasing in appearance.

As shown in FIG. 1, the ends 23 of the pipes 22 also may be enclosed by an adjustable louver assembly 32. The assembly 32 is conventional and generally comprises a plurality of movable blades 33 both for regulating the air output from the ends 23 of the pipes 22 and for controlling the output direction of that output air.

Figure 8:
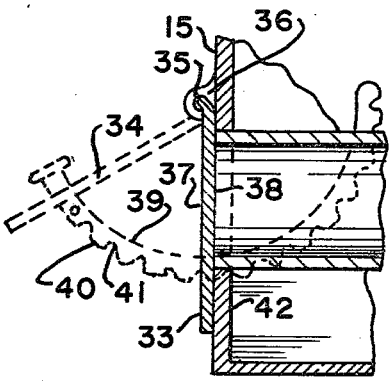
FIG. 8 is a sectional view taken along the line 8—8 of FIG. 6.
Figure 5:
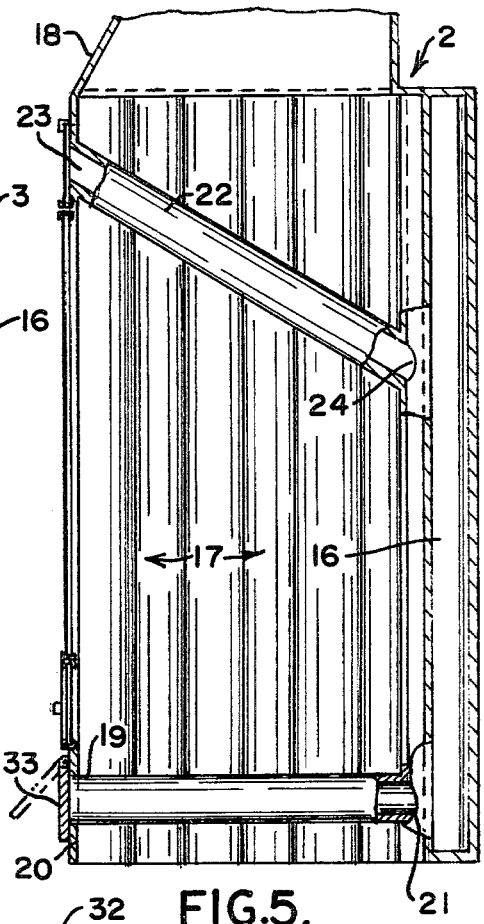
FIG. 5 is a sectional view, partly broken away, taken along the line 5—5 of FIG. 1.
Figure 9:
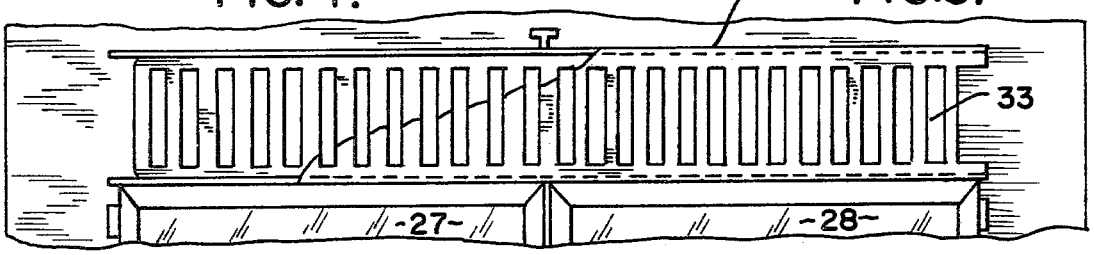
FIG. 9 is an enlarged view of the heated air in return used in conjunction with the embodiment of fireplace shown in FIG. 1.

Preferably, the ends 20 of the pipes 19 also are provided with an adjustable closure 33, shown in FIGS. 1, 5 and 8. The closure 33 preferably includes a cover plate 34 having an end 35 pivotally mounted along a suitable hinge means 36, best seen in FIG. 8. The closure 33 includes a first and second surface 37 and 38 separated by the material thickness of the closure. The surface 38 has a notched arcuate part 39 mounted to it in any convenient manner. The arcuate part 39 has a plurality of lands 40 and grooves 41 formed in it. The hinge mounting of the end 35 is provided with some free play so that the closure 34 may be rotated about the hinge 36 and to engage and disengage various ones of the lands and grooves along the material thickness of an edge 42 of the front 15 for the fireplace 2.

It thus may be observed that an improved heat transfer fireplace is provided which includes adjustable means for controlling the air input and output in heat transfer relationship with the fire box of the fireplace. The area available for heat transfer also is increased substantially over prior art designs.

Numerous variations, within the scope of the appended claims, will be apparent to those skilled in the art in light of the foregoing description and accompanying drawings. Thus, the design silhouette size and shape and various other dimensional features of the fireplace 2 may be varied in other embodiments of this invention. While the closures 33 and louver assembly 32 were shown as being manually operated, it will be apparent to those skilled in the art that electrically energizable means may be used to regulate input and output air through the heat chamber 16. For example, temperature responsive means sensitive to temperature of the room in which the fireplace 2 is placed may be used to regulate air flow through the heat chamber 16 of the fireplace 2. The same heat sensitive means may be used to control the operation of the fans 25, where those fans are employed in embodiments of this invention. Various attachment methods and interconnection techniques for the various component parts of the fireplace 2 may be altered in other embodiments of this invention. As indicated, the doors 27 and 28 may be constructed from a variety of materials. These variations are merely illustrative.

Having thus described the invention, what is claimed and desired to be secured by Letters Patent is:

1. A fireplace unit, comprising:

an enclosure including a first housing and a second housing, said second housing defining a fire box for consumption of combustible material, said first housing having a first pair of oppositely opposed side walls, a back wall and a bottom wall, all connected to one another, said second housing having a second pair of oppositely opposed side walls, a back wall, and a bottom wall, the side walls, back and bottom walls of said second housing being spaced from, but generally coextensive with the corresponding walls of said first housing to delimit a heat chamber about said fire box, individual ones of the side walls and the bottom wall of said second housing being formed from a single sheet of material having a plurality of undulations formed in it, the undulations having generally alternate peaks and valleys, the undulations of said bottom wall of said second housing defining with the bottom wall of said first housing a plurality of tubular sections extending along the depth of said fire box, said tubular sections communicating with the environment of said fireplace unit on one end and with said heat chamber on another end along the back walls of said first housing and said second housing:

a plurality of pipes extending along an upper end of said fire box and communicating with said heat chamber and the room environment of said fireplace so as to provide an air flow path from said room through said tubular sections to said heat chamber, and from said heat chamber through said plurality of pipes to said room, the heat chamber about said fire box enabling air in said air flow path to be heated from said fire box along the opposed side walls, back wall and bottom wall of said second housing, while said pipe plurality permits heating of air in said air path along the upper end of said fire box;

flue means connected to said fire box to conduct hot gases from said fire box past said plurality of pipes and to the atmosphere;

means for controlling air input to said heat chamber; and means for controlling air output from said plurality of pipes.

2. The fireplace unit of claim 1 wherein said means for controlling air input to said heat chamber includes power driven means for forcing air through said heat chamber.

3. The fireplace unit of claim 2 further including means for controlling air input of said tubular sections, said last mentioned means including louver means adjustably mounted to an intake side of said tubular sections.

4. The fireplace unit of claim 3 wherein said means for controlling air output from said plurality of pipes comprises louver means adjustably mounted to the outlet side of said plurality of pipes.

* * * * *